United States Patent [19]

Ikegami et al.

[11] 4,440,583

[45] Apr. 3, 1984

[54] METHOD OF CONTROLLED COOLING FOR STEEL STRIP

[75] Inventors: Hiroshi Ikegami; Norichika Nagira; Katsuhiko Yui, all of Kitakyushu, Japan

[73] Assignee: Nippon Steel Corporation, Tokyo, Japan

[21] Appl. No.: 442,431

[22] Filed: Nov. 17, 1982

[30] Foreign Application Priority Data

Jan. 11, 1982 [JP] Japan ..... 57-2584

[51] Int. Cl.[3] ..... C21D 11/00

[52] U.S. Cl. ..... 148/128; 266/80; 266/87; 148/156; 432/8

[58] Field of Search ..... 266/80, 81–88, 266/90, 113; 148/156, 128; 432/11, 12, 8, 43, 45; 72/201

[56] References Cited

U.S. PATENT DOCUMENTS

| | | | |
|---|---|---|---|
| 3,533,261 | 10/1970 | Hollander et al. | 266/113 |
| 3,589,160 | 6/1971 | Gruver et al. | 72/201 |
| 3,604,234 | 9/1971 | Hinricksen | 72/13 |
| 3,613,418 | 10/1971 | Nara et al. | 266/113 |
| 3,779,054 | 12/1973 | Greenberger | 72/13 |
| 4,243,441 | 1/1981 | Wilson | 148/128 |

*Primary Examiner*—Christopher W. Brody

*Attorney, Agent, or Firm*—Wenderoth, Lind & Ponack

[57] ABSTRACT

In controlledly cooling steel strip in a continuous annealing line, the heat transfer rate needed for attaining the desired cooling rate is calculated from an equation including strip thickness, the cooling starting and finishing temperatures, and the desired cooling rate, and the obtained heat transfer rate is corrected according to the effect of natural cooling in idle-pass zones preceding and following the coolant spray zone. The flow rate of coolant is determined and set by using an equation expressing the predetermined relationship between the heat transfer rate and coolant flow rate. The length of the coolant spraying region extending in the direction of strip travel is calculated from the running speed of the strip, the cooling starting and finishing temperatures, and the desired cooling rate. The nozzles are set to turn on and off so that the coolant is sprayed from such a number of nozzles as correspond to the length of the spraying region thus calculated. Based on these settings, the coolant flow rate is corrected by re-calculating the heat transfer rate when strip thickness varies in the course of controlled cooling. Also, the on-off pattern of the nozzles is corrected by re-calculating the length of the coolant spraying region when the running speed of the strip varies.

1 Claim, 6 Drawing Figures

METHOD OF CONTROLLED COOLING FOR STEEL STRIP

BACKGROUND OF THE INVENTION

This invention relates to a method of controlled cooling for steel strip at high temperatures. More particularly, it relates to a method of controlling the cooling of steel strip to an aimed-for temperature at a desired cooling rate.

The main object of the controlled cooling of steel strip has been to cool it to the aimed-for temperature. This object has been achieved by several methods such as adjusting the number of coolant ejecting nozzles and regulating the quantity of coolant ejected through nozzles. The same holds true with the controlled cooling implemented in the continuous annealing of steel strip, in which, however, the cooling rate also constitutes an important factor. If the primary cooling rate in a continuous annealing process is too low, the degree of supersaturation of the solid solution of carbon in steel drops, as a consequence of which the force to cause the precipitation of carbide lessens and the overaging time lengthens. If, on the other hand, the cooling rate is so high as not to permit end-point control, the strip once cooled to room temperature is reheated to the overaging temperature, with a resulting transgranular fine dispersion of carbide precipitates deteriorating the ductility of the steel.

There arises problems in the manufacture of high-tensile steel plates (such as of the dual-phase structure type), as well. If the cooling rate is too low, much alloying element material will be needed to obtain the desired strength. Too high a cooling rate, on the other hand, fails to provide adequate ductility. Consequently, quenched solid solution of carbon has to be reheated for overaging precipitation at such a low temperature at which the formed martensite does not break. Even this corrective step cannot fully make up for the deterioration in ductility caused by the fine carbide. In other words, the cooling rate should neither exceed nor fall short of the appropriate level. Incidentally, the aimed-for cooling temperature governs the rate at which solid solution of carbon precipitates.

As is now obvious, the cooling rate is an important factor, but there has been no appropriate measures to control it, with the conventional techniques confined to the control of the desired cooling temperature.

SUMMARY OF THE INVENTION

The object of this invention is to provide a method of controlled cooling for steel strip which permits controlling the cooling rate as well as the cooling temperature to the desired values.

The method of controlled cooling for steel strip according to this invention is implemented by use of a cooling apparatus comprising a plurality of nozzles disposed in the direction in which strip travels, the nozzles spraying coolant against the hot running strip, and a flow-rate control valve attached to the pipe that supplies the coolant to the nozzles. By using an equation containing the thickness of strip, the cooling starting and finishing temperatures, and the desired cooling rate, the heat transfer rate needed to obtain the desired cooling rate is calculated, and the obtained heat transfer rate is corrected according to the effect of natural cooling in idle-pass zones preceding and following the coolant spray zone. Then the flow rate of the coolant is derived, and set, from its pre-established relationship with the heat transfer rate. The length of the coolant spraying zone along the strip travel path is calculated using the running speed of the strip, the cooling starting and finishing temperatures, and the desired cooling rate. The nozzles are set to turn on and off so that coolant is sprayed from only such a number of nozzles as correspond to the calculated value. When strip thickness varies while controlled cooling is being effected, the heat transfer rate is re-calculated, on the basis of the above settings, to correct the coolant flow rate accordingly. When strip speed varies, the length of the coolant spraying region is re-calculated to correct the on-off pattern of the nozzles.

As will be understood from the above, this invention controls cooling on the basis of the aimed-for cooling finishing temperature and the aimed-for cooling rate and by taking into account the effect of natural cooling in the idle-pass zones. Variations in strip thickness are coped with by correcting the coolant flow rate and variations in strip speed are compensated for by correcting the length of the coolant spraying region. This makes it possible to cool steel strip to the desired temperature at the desired cooling rate. This permits cooling under delicate conditions involved in the exact heat treatment essential for the production of high-quality steel strip.

DETAILED DESCRIPTION OF THE PREFERRED EMBODIMENTS

Figure 1:
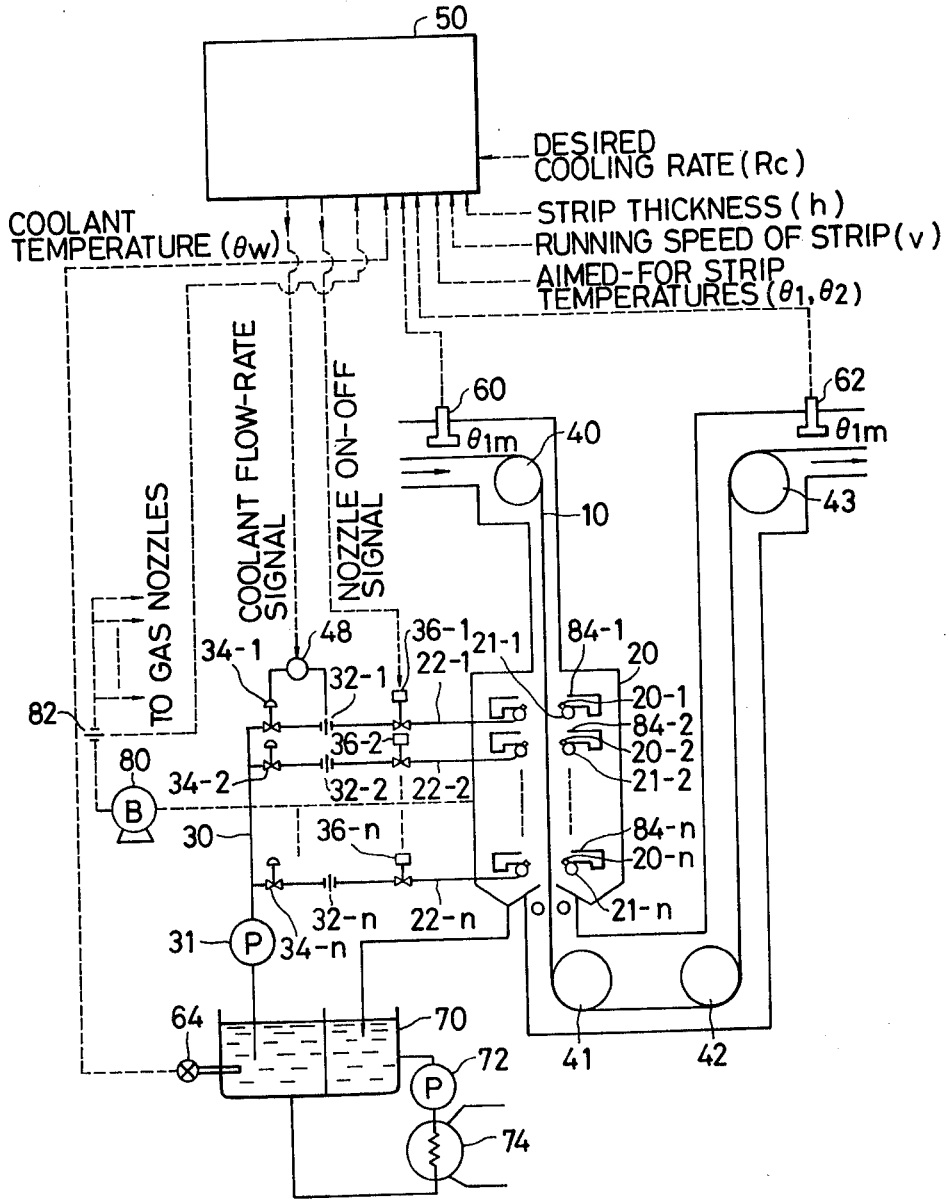
FIG. 1 is block diagram showing the construction of a control system with which the method of this invention is implemented.

The following paragraphs provide a detailed description of this invention by reference to accompanying drawings. FIG. 1 shows a control system in a preferred embodiment of this invention. Reference numeral 10 designates a steel strip to be continuously annealed and reference numeral 20 indicates a cooling zone. After passing through the heating process not shown, the strip 10 is cooled in the cooling zone 20 and then proceeds into the next overaging process. Items 20-1, 20-2, . . . and 20-n are the first, second, . . . and n-th nozzles to spray liquid coolant (such as water). Each of the nozzles 20-1, 20-2, . . . and 20-n comprises a plurality of nozzles carried by nozzle headers 21-1, 21-2, . . . and 21-n to cover the width of the strip. Gas nozzles 84-1, 84-2, . . . and 84-n eject an atomizing gas (such as nitrogen gas) against the water sprayed from the liquid coolant nozzles. Consequently, the strip 10 is cooled by a mixture of water and nitrogen gas sprayed over its surface. The gas nozzles 84-1, 84-2, . . . and 84-n are adjacent to the liquid coolant nozzles 20-1, 20-2, . . . and 20-n. The liquid coolant is atomized by the gas ejected from the gas nozzles 84-1, 84-2, . . . and 84-n. Reference numeral 22-1 denotes a coolant supply tube for the first nozzle 20-1. A flow-rate signal generator 32-1, a flow-rate control valve 34-1, and a cutoff valve 36-1 are inserted in this tube 22-1. There is no need to provide the cutoff valve 36-1 if the flow-rate control valve 34-1 can stop the flow of water with certainty. Similar coolant supply tubes 22-2 through 22-n, flow-rate control valves 34-2 through 34-n, and the like are provided for the second to n-th nozzles 20-2 through 20-n. Reference numeral 30 designates a main header leading to the coolant supply tubes 22-1 through 22-n, and reference numeral 31 indicates a coolant supply pump. Reference numerals 40 through 43 denote guide rolls. Item 48 is a flow-rate controller and item 50 is a commonly marketed control computer such as the PDP-11 of Digital Equipment Corporation of the United States. Items 60 and 62 are pyrometers to measure the strip temperature at the entry and exit ends of the cooling zone. Item 64 is a thermometer to measure the temperature of the liquid coolant. Reference numeral 70 designates a liquid coolant recirculation tank, 72 a pump to send the returned high-temperature liquid coolant to a heat exchanger 74, 80 a blower forcibly supplying the liquid coolant atomizing gas, and 82 a gas flow-rate signal generator.

The heat Qs deprived of the steel strip cooled in the continuous cooling apparatus just described can be expressed as $$Qs = vhB\gamma Cm(\theta_1 - \theta_2) \quad (1)$$

where v = running speed of the strip
h = thickness of the strip
B = width of the strip
$\gamma$ = specific gravity of the strip
Cm = specific heat of the strip
$\theta_1$ = temperature at which the cooling of the strip begins
$\theta_2$ = temperature at which the cooling of the strip ends.

Meanwhile, the heat Qc the cooling apparatus takes away from the strip is $$Qc = 2BL\alpha\Delta\theta m \quad (2)$$

where $\alpha$ = heat transfer rate between the strip and coolant

L = cooling region length (length of the region in which the coolant is sprayed extending in the direction of strip travel)

$\Delta\theta$m = logarithmic mean temperature difference between the strip and coolant, which is expressed as follows:

$$\Delta\theta m = \frac{\theta_1 - \theta_w}{\ln \frac{\theta_1 - \theta_w}{\theta_2 - \theta_w}} \quad (2)'$$

where $\theta_w$ = temperature of the coolant sprayed.

The cooling rate Rc (the temperature drop in a unit time) of the strip is expressed as $$Rc = \frac{v}{L} \cdot (\theta_1 - \theta_2) \quad (3)$$

Since Qs = Qc, from equations (1) and (2), $$\theta_1 - \theta_2 = \frac{2L\alpha\Delta\theta m}{vh\gamma Cm} \quad (4)$$

By inserting equation (4) in equation (3), $$\alpha = \frac{h\gamma Cm}{2\Delta\theta m} \cdot Rc \quad (5)$$

When the desired cooling rate Rc is given, the heat transfer rate $\alpha$ needed to achieve that cooling rate can be obtained from equation (5). The relationship between the heat transfer rate $\alpha$ and the quantity of sprayed coolant varies with the method by which the coolant is sprayed, and various equations representing their relationship have been reported. Studies conducted by the inventors have shown that the heat transfer rate $\alpha$ can be expressed as follows when only liquid coolant is sprayed through the nozzles in the continuous annealing apparatus with a flow density (the quantity of coolant sprayed over a unit area of strip in a unit time) W, $$\alpha = K_1 W^a \quad (6)$$

where $K_1$ and a are empirically determined constants. This equation has proved to provide the heat transfer rate $\alpha$ with practically adequate accuracy. From equation (6), the required flow density W of the liquid coolant is expressed as $$W = \left(\frac{\alpha}{K_1}\right)^{\frac{1}{a}} \quad (7)$$

As a result of experiments, the following equation has proved practically applicable to the case in which gas-atomized liquid coolant is sprayed:

$$\alpha = K_2 W^a G^b \quad (8)$$

where $K_2$, a and b are empirically determined constants, and G is the flow density of the atomizing gas. Therefore, the required flow density W of the liquid coolant is expressed as $$W = \left(\frac{\alpha}{K_2 G^b}\right)^{\frac{1}{a}} \quad (9)$$

The gas flow density G must be high enough to accomplish this required atomization. It is conceivable to vary the gas flow density G according to the varying liquid coolant flow density W. Usually, however, stable atomization is easily achieved by fixing such a gas flow density as is empirically established as necessary for the maximum liquid coolant flow density set by the apparatus specification. Eventually, the liquid coolant flow density W needed for the realization of the desired cooling rate Rc can be derived from equation (5) and equation (7) or (9). Next, to attain the desired cooling finishing temperature $\theta_2$, determine the length of the cooling region L from the following equation derived from equation (3), and then turn on (open) such a number of nozzles (from the first to the i-th nozzle) as correspond to the length L thus determined and turn off (close) the remaining nozzles (from the j-th to the n-th nozzle).

$$L = \frac{v}{Rc} \cdot (\theta_1 - \theta_2) \tag{10}$$

Figure 2:
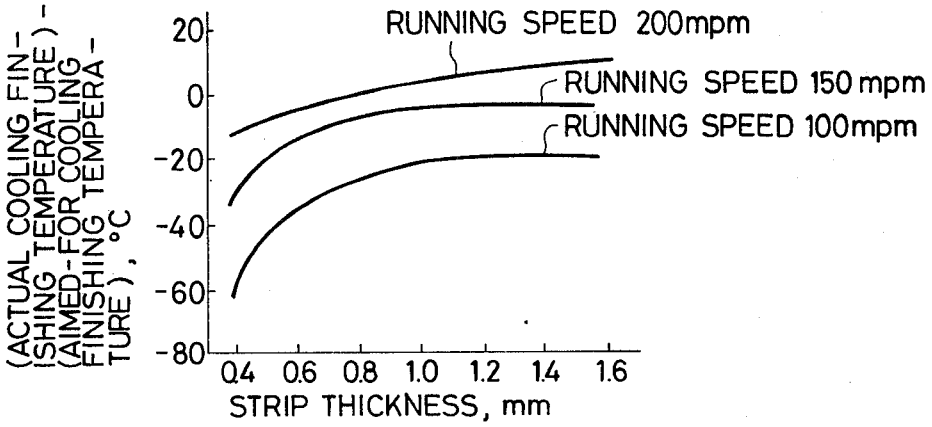
FIG. 2 is a graph showing the effect the natural cooling in the idle-pass zone of a continuous annealing furnace exercises on the cooling finishing temperature.

To sum up, when the cooling starting temperature $\theta_1$, cooling finishing temperature $\theta_2$, and cooling rate Rc are given as the factors of a heat cycle, the heat transfer rate $\alpha$ corresponding to strip thickness h is determined from equation (5). Then the coolant flow rate is derived from the obtained heat transfer rate, thereby bringing the coolant flow rate in proportion to the strip thickness h. Using equation (10), the cooling region length L also can be brought in proportion to the strip running speed v. By so doing, the given heat cycle can be maintained at all times. In an actual strip cooling apparatus, however, the strip temperature measuring point on the entry side (where the pyrometer 60 is positioned) is somewhat away from the point where coolant spray begins because of the space occupied by individual pieces of equipment. Likewise, some distance is kept between the coolant spray finishing point and the strip temperature measuring point on the exit side (where the pyrometer 62 is positioned). These two sections are called idle-pass zones, in which the strip is naturally cooled. Experiments have shown that the natural cooling in the idle-pass zone presents no problems when the strip travels at high speed (e.g., not slower than 200 m per minute), the resulting temperature drop being not greater than approximately 5° to 10° C. When the strip speed is low, especially when the strip thickness is thin, a problem arises. If the measurements at the pyrometers 60 and 62 are adopted as the cooling starting and finishing temperatures $\theta_1$ and $\theta_2$, respectively, in the cooling control based on equations (5) through (10), actual cooling finishing temperature will be lower than the aimed-for cooling finishing temperature as shown in FIG. 2. To perform the control of strip cooling with higher accuracy, therefore, due consideration must be given to the natural cooling in the idle-pass zones.

It is theoretically possible to describe the cooling in the idle-pass zone using an equation separate from the one for the cooling in the coolant spraying zone. But it is impossible to establish the exact coefficient for such an independent equation because actual equipment has no means to tell the strip temperature at the border between the idle-pass and coolant spraying zone.

Figure 3:
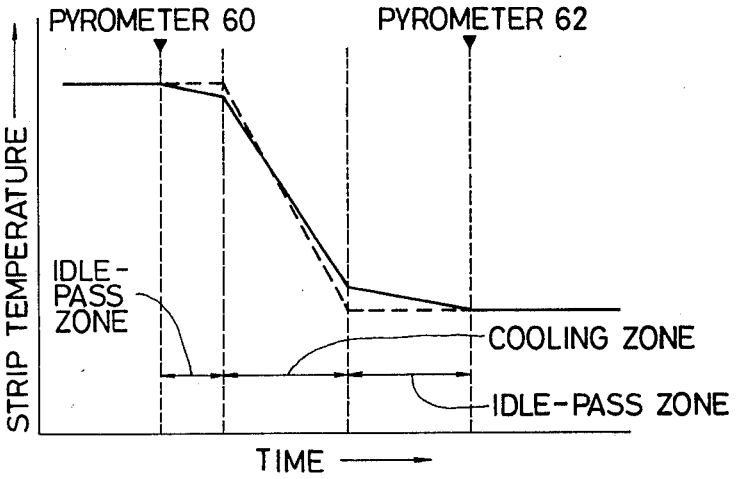
FIG. 3 is a graph illustrating how the effect of the natural cooling in the idle-pass zone is made up for by correcting the heat transfer rate.
Figure 4:
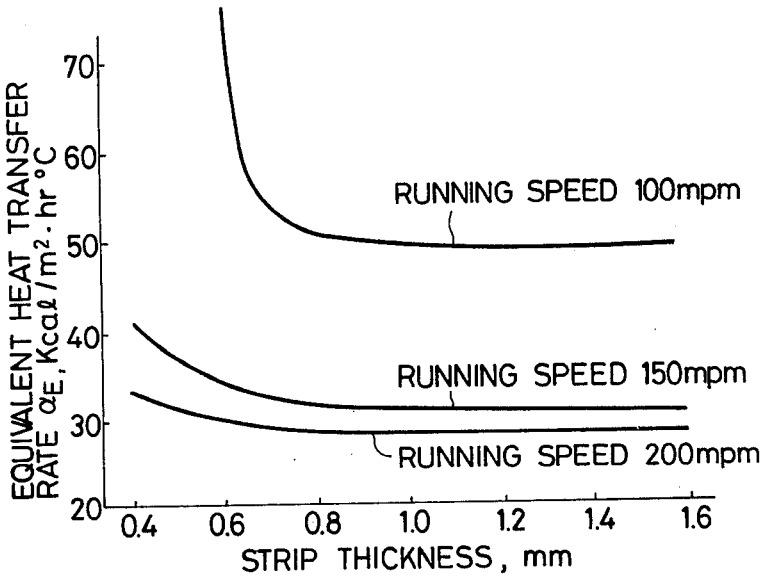
FIG. 4 is a graph showing an example of the heat transfer rate corrected with consideration for the natural cooling in the idle-pass zone.

This invention provides means for making up for the effect of the natural cooling in the idle-pass zone based on the results of experiments conducted on actual equipment. The basic concept is to use an apparent cooling process, indicated by a broken line in FIG. 3, in place of the actual cooling process indicated by a solid line. For this purpose, a heat transfer rate $\alpha_E$ (hereinafter called the equivalent heat transfer rate) is used which is obtained by correcting the heat transfer rate $\alpha$ derived from equation (5) to correspond to the apparent cooling process. The equivalent heat transfer rate $\alpha_E$ becomes greater as the temperature drop in the idle-pass zone increases with a decrease in the strip thickness and strip running speed. In determining the flow density of liquid coolant from equation (7) or (9), $\alpha$ in the equation is replaced by $\alpha_E$ that is corrected for the strip thickness and running speed. From various studies, it has been found that $\alpha_E$ is best expressed in the following form:

$$\alpha_E = \left(C_1 + \frac{C_2}{v^2 h}\right) \alpha \tag{11}$$

By using the corrected heat transfer rate $\alpha_E$, the flow density of liquid coolant is determined as follows:

$$W = \left(\frac{\alpha_E}{K_1}\right)^{\frac{1}{a}} \tag{7'}$$

$$W = \left(\frac{\alpha_E}{K_2 G^b}\right)^{\frac{1}{a}} \tag{9'}$$

Figure 5:
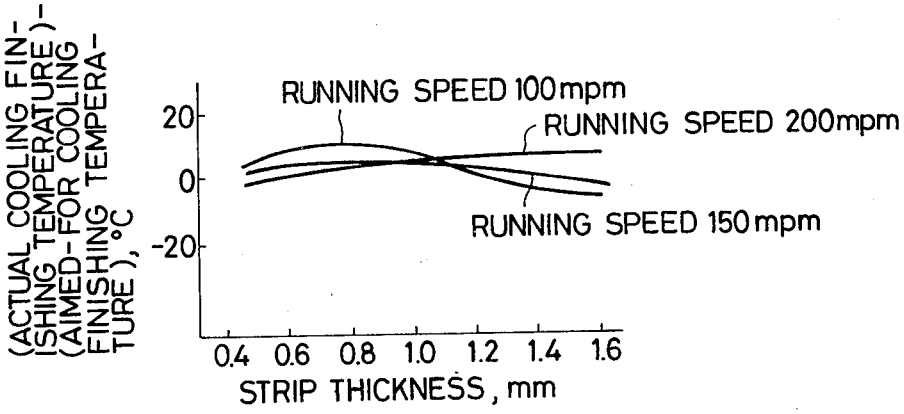
FIG. 5 is a graph showing the effect achieved by the correction of the heat transfer rate.

FIG. 5 shows the accuracy with which the cooling finishing temperature is determined by use of the corrected heat transfer rate $\alpha_E$. As will become evident when compared with FIG. 2, the temperature control accuracy is greatly improved. The value of coefficients $C_1$ and $C_2$ in equation 11 can be found by determining the actual heat transfer rate $\alpha m$ from the strip temperatures $\theta_{1m}$ and $\theta_2$m, the coolant temperature $\theta_{wm}$, the strip travel speed $v_m$, and the cooling region length L, by using equations (3) and (5), and then substituting the actual heat transfer rate $\alpha_m$ for $\alpha$ in equation (7)' (9)' for multiple regression analysis.

Figure 6:
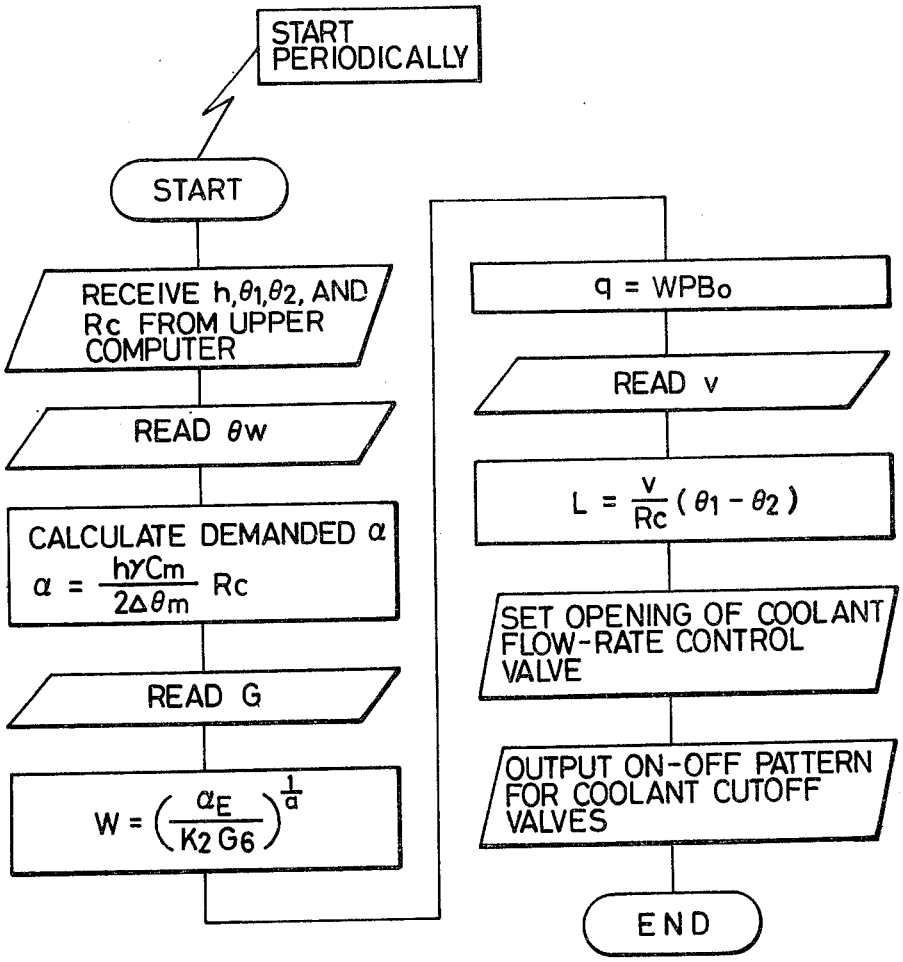
FIG. 6 is a flow chart of the calculation conducted by a control computer according to the method of this invention.

Referring now to FIGS. 1 and 6, more concrete aspects of the control method just described will be explained in the following. In the example described in the following, coolant atomizing gas is used and the heat transfer rate is corrected to enhance the temperature control accuracy. To begin with, the strip thickness h, aimed-for cooling starting temperature $\theta_1$ and cooling finishing temperature $\theta_2$, and aimed-for cooling rate Rc are inputted from an upper computer or a manual setter, not shown, to the control computer 50. Using equation (5), the control computer 50 calculates the heat transfer rate $\alpha$ necessary for the achievement of the given cooling rate Rc. Before performing this calculation, the specific gravity $\gamma$ and specific heat $C_m$ of the strip are preliminarily memorized as constants in the control computer 50. The signal from the thermometer 64 is used as the coolant temperature $\theta_w$ necessary for the calculation of $\Delta\theta$m (refer to equation (2)'). Then the required coolant flow density W is determined from equation (9)'. In solving equation (9)', the signal from the signal generator 82 is used as the flow rate G of the atomizing gas. The cooling region length L is calculated by using equation (10). The strip running speed v in equation (10) is dependent upon the capacity of the heating furnace in the continuous annealing equipment, and is determined by a control system not shown for input in the computer 50. With the coolant flow density W and the cooling region length L thus determined, the coolant flow rate q through each of the coolant spray nozzles 20-1, 20-2, etc. is expressed as $$q = W \cdot P \cdot B_0 \tag{12}$$

where P is the intervals at which the nozzles are arranged in the direction of strip travel, and $B_0$ is the intervals at which the plurality of nozzles 20-1, 20-2, . . . and 20-n are arranged on each of the nozzle headers

84-1, 84-2, . . . and 84-n multiplied by the number of nozzles.

In the continuous annealing of steel strip, it frequently happens that strips of different thicknesses welded together are annealed continuously. In such a case, different heating and cooling conditions are applied to the strips of different thicknesses, switching being effected at the welded joint. The changes in the heating and cooling conditions include the one in the line speed of the continuous annealing equipment or the strip running speed v. The strip running speed v is also changed when any trouble occurs in the equipment preceding and following the annealing furnace.

The variation in the thickness h of the strip to be annealed is previously inputted in the upper computer. The joints between strips of different thicknesses are detected by a tracking means. This tracking means is a known device to measure the amount of strip travel which comprises a photoelectric sensor positioned at the entrance or exit of the heating furnace or cooling zone, a pulse signal generator and a pulse counter connected to the bridle roll in the neighborhood of the photoelectric sensor. The photoelectric sensor detects the reference hole provided near the joint, whereby the position of the joint in the line can be determined by measuring the distance over which the strip has travelled since the time at which the reference hole was found.

The running speed of the strip is detected by an ordinary speed detector provided at the entry or exit end of, for example, the heating furnace or cooling zone in the continuous annealing equipment.

Invariably monitoring for the variation in the strip thickness and running speed, the control computer 50 performs the aforementioned calculations and changes the coolant flow rate or cooling region length accordingly. When the strip thickness h varies, the heat transfer rate and liquid coolant flow rate are re-calculated from equations (5) and (9)′ respectively. Then, the liquid coolant flow rate is adjusted by actuating the control valves 34-1, etc. When the strip running speed v varies, the cooling region length is re-calculated from equation (10). Then, the cooling region length is adjusted by turning on or off the nozzles 20-1, etc. through the operation of the cutoff valves 36-1, etc. At this time, the gas nozzles 84-1, 84-2, . . . and 84-n are neither turned on nor off, with the atomizing gas allowed to flow continuously. As mentioned previously, the thickness h of the strip travelling through the cooling apparatus is tracked by the upper computer, and the obtained information is at all times supplied to the control computer 50. Although the strip running speed v is usually controlled by a separate computer, actual speed is used in the calculation for cooling control when the operator has changed it manually. The cooling starting temperature $\theta_1$ also is usually controlled by a separate control system in the heating or soaking furnace provided ahead of the cooling apparatus. But when the measured temperature $\theta_{1m}$ (the signal from the pyrometer 60) differs from the aimed-for value $\theta_1$, $\theta_{1m}$ is used in place of $\theta_1$ in calculating the cooling region length from equation (10).

The temperature $\theta_{2m}$ detected by the pyrometer 62 is used for the feedback control of the cooling finishing temperature (aimed at $\theta_2$). That is to say, the coolant flow rate q is finely adjusted so that $\theta\Delta=\theta_{2m}-\theta_2$, thereby correcting the deviation in the strip temperature induced by the error in equation (9)′.

Next, a preferred embodiment of this invention will be described. Steel strip was cooled under the following conditions by using the method of this invention: Strip thickness h=1.0 mm, cooling starting temperature $\theta_1=700°$ C., cooling finishing temperature $\theta_2=400°$ C., cooling rate Rc=100° C./sec, strip running speed v=200 m/min, coolant temperature $\theta_w=50°$ C., and gas flow density G=50 $Nm^3/m^2min$.

Using the above conditions and the equations described before, the coolant flow rate q through each nozzle and the cooling region length L can be determined as follows:

From equation (2)′, the logarithmic mean temperature difference $\Delta\theta$ is 485° C. From equation (5), the heat transfer rate $\alpha$ is 524 $kcal/m^2h°C$. From equation (9), the liquid coolant flow density W is 210 $1/m^2min$. From these values and equations (12) and (10), q=105 l/min and L=10 m.

Under these conditions, the strip was cooled to the cooling finishing temperature of 400±10° C. at the cooling rate of 100°±5° C.

As described above, this invention provides a technique to control the cooling finishing temperature and cooling rate to the desired levels, which is effectively applicable to the continuous annealing of steel strip and so on.

What is claimed is:

1. In a method of controlledly cooling steel strip in a cooling apparatus of a continuous annealing line comprising a plurality of nozzles spraying a coolant against the hot strip arranged in the direction in which the strip travels and a flow-rate control valve provided in a coolant supply tube leading to said nozzles, the improvement which comprises calculating the heat transfer rate necessary for obtaining a desired cooling rate by using an equation including the thickness of the strip, the cooling starting and finishing temperatures, and the desired cooling rate, correcting the obtained heat transfer rate according to the effect of natural cooling in idle-pass zones preceding and following the coolant spray zone, calculating and setting a coolant flow rate from an equation expressing the predetermined relationship between the heat transfer rate and coolant flow rate, calculating the length of the coolant spraying region in the direction of strip travel from the running speed of the strip, the cooling starting and finishing temperatures, and the desired cooling rate, setting the nozzles to be turned on and off so that the coolant is ejected from such a number of nozzles as correspond to the calculated length of the spraying region, correcting the coolant flow rate by re-calculating the heat transfer rate on the basis of said settings when the strip thickness varies while being controlled-cooled, and correcting the on-off pattern of the nozzles by re-calculating the length of the spraying region when the strip running speed varies.

* * * * *